United States Patent [19]

Grice

[11] 3,938,223

[45] Feb. 17, 1976

[54] AUTO LEVELER

[75] Inventor: Karl R. Grice, Honea Path, S.C.

[73] Assignee: Fiber Controls Corporation, Gastonia, N.C.

[22] Filed: Jan. 6, 1975

[21] Appl. No.: 538,875

[52] U.S. Cl. ..... 19/240; 73/32 R; 73/160

[51] Int. Cl.[2] ..... D01H 5/38

[58] Field of Search ..... 73/32 R, 160; 19/240

[56] References Cited

UNITED STATES PATENTS

| | | | |
|---|---|---|---|
| 3,363,459 | 1/1968 | Brown | 73/160 |
| 3,827,106 | 8/1974 | Varga | 19/240 |
| 3,862,473 | 1/1975 | Felix et al. | 19/240 |

FOREIGN PATENTS OR APPLICATIONS

| | | | |
|---|---|---|---|
| 18,869 | 11/1965 | Japan | 73/160 |

*Primary Examiner*—James J. Gilu

*Attorney, Agent, or Firm*—Cushman, Darby & Cushman

[57] ABSTRACT

An apparatus for maintaining sliver thickness uniform whereby the web from a carding machine is gathered by a trumpet and passed between a grooved driven roller and a sensor roller riding in the groove so that the movements of the sensor roller vary as a function of sliver density. The sensor roller is mechanically connected to a magnetic core so that movement of the sensor roller varies the coupling between a primary transformer winding and a pair of secondary windings. The voltages induced in the secondary windings are applied, after a delay, to a first differential amplifier whose output in turn is connected to a second differential amplifier which is periodically rendered operative by a pulse generator and to which is also connected a potentiometer for adjusting desired density. The output of the second amplifier is connected to a pair of relay coils, one responsive to positive excursions and the other to negative. Each relay controls a switch connecting a power source to a motor coil for rotating the motor which in turn controls a variable speed drive for controlling, for example, the feed roll of a conventional card.

8 Claims, 4 Drawing Figures

AUTO LEVELER

BRIEF DESCRIPTION OF THE PRIOR ART AND SUMMARY OF THE INVENTION

The invention relates to an apparatus for maintaining uniform density of sliver strands produced by textile machines such as cards and the like.

One step in the processing of textile fibers such as cotton, wool, synthetic fibers, or any other type of textile fibers involves forming these small fibers into a long interlocked chain known in the art as a sliver. This function is usually accomplished by a machine termed a card, but other textile processing equipment such as draw frames and pin drafters also produce slivers. These slivers are conventionally coiled or otherwise stored for further processing into textile yarn or thread which can be then woven or otherwise manipulated into textile material.

It is important that the density or thickness of the sliver be maintained substantially uniform. In the absence of monitoring of this thickness or density, there is a tendency for the sliver density to drift away from a desired value which produces a product which is unsatisfactory for further processing. In view of the speed of operation of modern carding machines, it is virtually impossible for visual observation or periodic manual testing to satisfactorily maintain a desired density.

Thickness regulating device, commonly known by the term "auto-levelers," are well known in the textile art and have been successfully employed for many years. For example, an auto-leveler manufactured by Crosrol includes a first roller having a groove in the outer peripheral surface thereof in which a second roller rides. Strands produced by a carding machine, after being formed into a sliver, continuingly pass between the two rollers so that the movements of the roller riding in the groove vary as a function of the thickness and density of the sliver. These movements are detected to produce an electrical signal which is integrated and compared electrically with a desired value to control the relative speeds of the doffer and feed rolls of the card machine which in turn controls the sliver density.

British Pat. No. 930,873 describes another textile processing system of this type in which the sliver moves between two rollers with the movement of a second roller on top of the sliver being detected to vary the relative speeds of doffer and feed rolls. In the British patent, a magnet core is mechanically connected to the upper roller and disposed between a primary transformer winding and a pair of secondary windings so that the relative position of the core determines the voltages which appear at the two secondary windings. These secondary windings are in turn used to control a variable speed device which is applied to the feed element of the card machine.

My copending application, Ser. No. 543,808 filed Dec. 20, 1974 as a continuation of my copending application, Ser. No. 411,841 filed Nov. 1, 1973, now abandoned, describes an auto leveler of this general type in which the thickness of the sliver is detected sonically or ultrasonically to produce an electrical signal which controls a variable speed device coupled to the feed roll.

A further application by Cecil S. Wise, Ser. No. 475,312, filed May 31, 1974, describes a similar system which includes circuitry which is periodically actuated to adjust the density and which is kept inoperative between adjustments to avoid oscillation of sliver density.

The present invention relates to an improved apparatus of this type. As described in detail below, the thickness and density of a sliver continuously passing between a rotating grooved roller and a sensor roller riding on the sliver is detected by movement of a magnet core coupled for movement with the upper roller and which is disposed for alternating the coupling between primary and secondary coils of a transformer. Preferably, the transformer includes first and second secondary coils so that the amplitudes of the respective output voltages of these coils are directly related to the position of the core and accordingly the thickness of the sliver. The signals produced by the two secondary coils are delayed in time by a simple integration circuit to avoid changes in density resulting from detecting a minor irregularity in the sliver and applied to a first differential amplifier which produces an output voltage which varies as a function of the difference between the two input signals.

This outpupt voltage is in turn applied to a second differential amplifier which is periodically rendered operative by a pulse generator for a short period. The other input to the second amplifier is used to adjust the desired sliver thickness. When the second amplifier is activated, an amplified signal is applied to a pair of relays, one responsive to positive excursions of the waveform and other responsive to negative excursions. Each of these relays operates a controlled switch which, when the relay is activated, completes a current path through a coil of a conventional control device which operates an armature to control a variable speed device connected to one of the two rollers which control the thickness of the sliver, for example, the feed roll on a conventional card.

Many other objects and purposes of the invention will be clear from the following detailed description of the drawings.

DETAILED DESCRIPTION OF THE DRAWINGS

Figure 1:
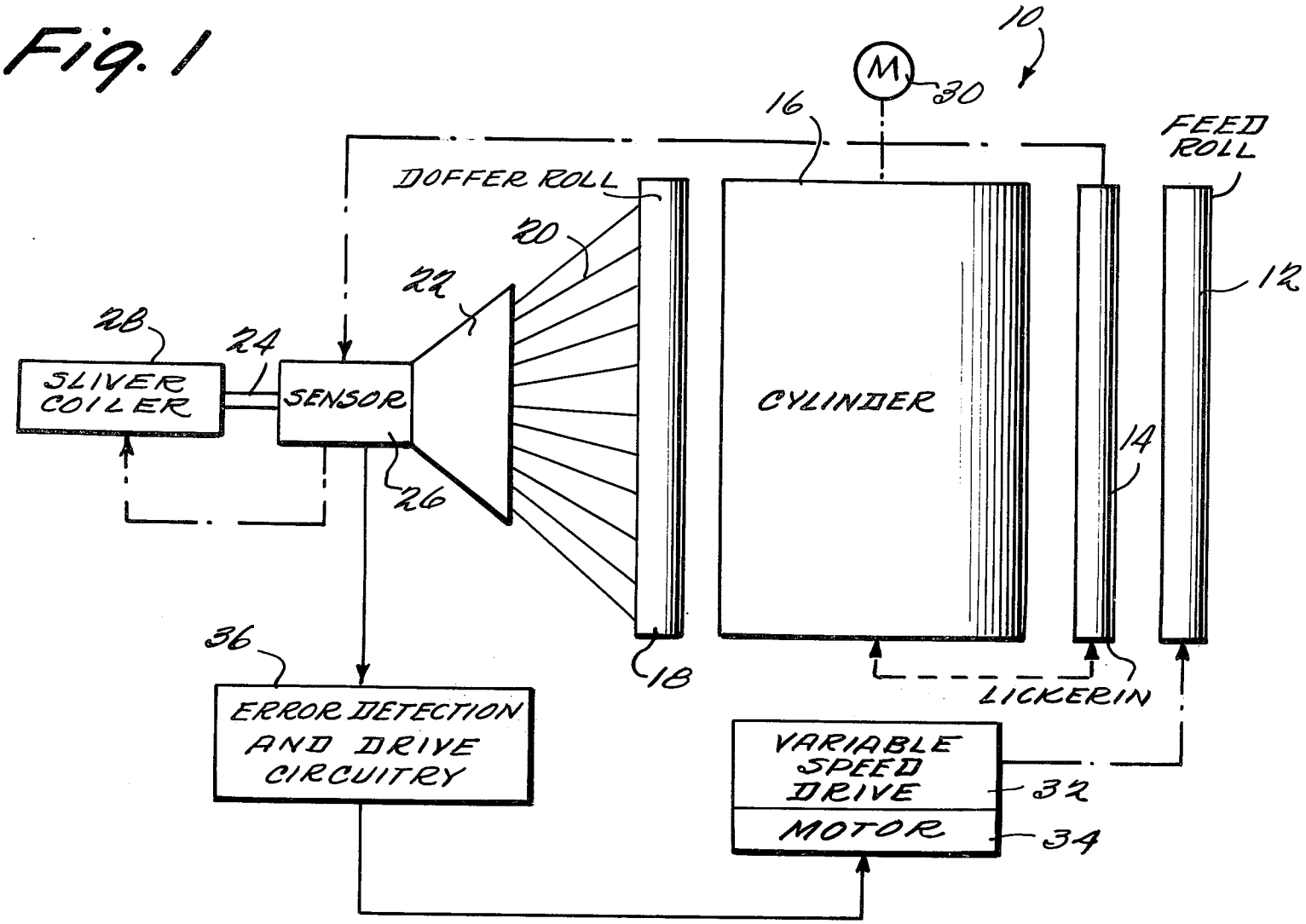
FIG. 1 shows a schematic diagrammatic view of one embodiment of the invention of this application.

Reference is now made to FIG. 1 which illustrates a schematic view of the unique invention of this application. It should be appreciated that while FIG. 1 schematically illustrates the invention in combination with a conventional card, the invention finds utility in conjunction with operation of any type of textile processing equipment that produces slivers.

The carding machine 10 may be of any suitable type provided with the usual feed roll 12, lickerin 14, large fiber paralleling cylinder 16, and a conventional doffer roll 18. As is well known, roll 18 doffs cylinder 16 to remove therefrom a fine web of parallel strands. These parallel strands are brought together as a web 20 by a trumpet 22 which is directly connected to sensor 26 which is illustrated in detail in FIGS. 2 and 3. The slivers which are gathered by trumpet 22 are pulled therethrough and then through sensor 26 which includes, as described below, cooperating tongue and groove type rollers. Thereafter, the sliver is coiled in the usual manner by coiler 28.

As is also conventional, an electrical motor 30 drives cylinder 16, lickerin 14, doffer 18 and one of the rolls of sensor 26. The feed roller, however, is driven through a variable speed drive 32 to which there is connected an electrical motor 34. This variable speed device 32 is preferably of the type which combines infinitely variable speed control with positive power transmission, e.g., the "PIV" type supplied by the Link-Belt Enclosed Drive Division of the FMC Corporation, such as shown in book 3074078(2), especially the electrically controlled models thereof shown and described on pages 46 and 47 of the book. These latter variable speed drives therefore include motor 34 of FIG. 1.

As indicated above, the sliver 24 passes through sensor 26 which responds to the cross-section of the sliver and accordingly to its thickness and density to cause the operation of the error detection and drive circuitry 36 which is described in detail below in FIG. 4. Circuitry 36 operates to adjust the motor 34 when the sliver thickness varies from the acceptable range. More particularly, operation of circuitry 36 produces an electrical signal which is connected to motor 34 to cause it to rotate in a forward or reverse direction and consequentially to vary the speed of the variable speed drive 32 in a known manner. Varying the speed of drive 32 in turn causes feed roll 12 to increase or decrease its speed relative to doffer roll 18 as well as the other components driven by motor 30. This results in a variation of the sliver cross section to return it to an acceptable level.

Figure 2:
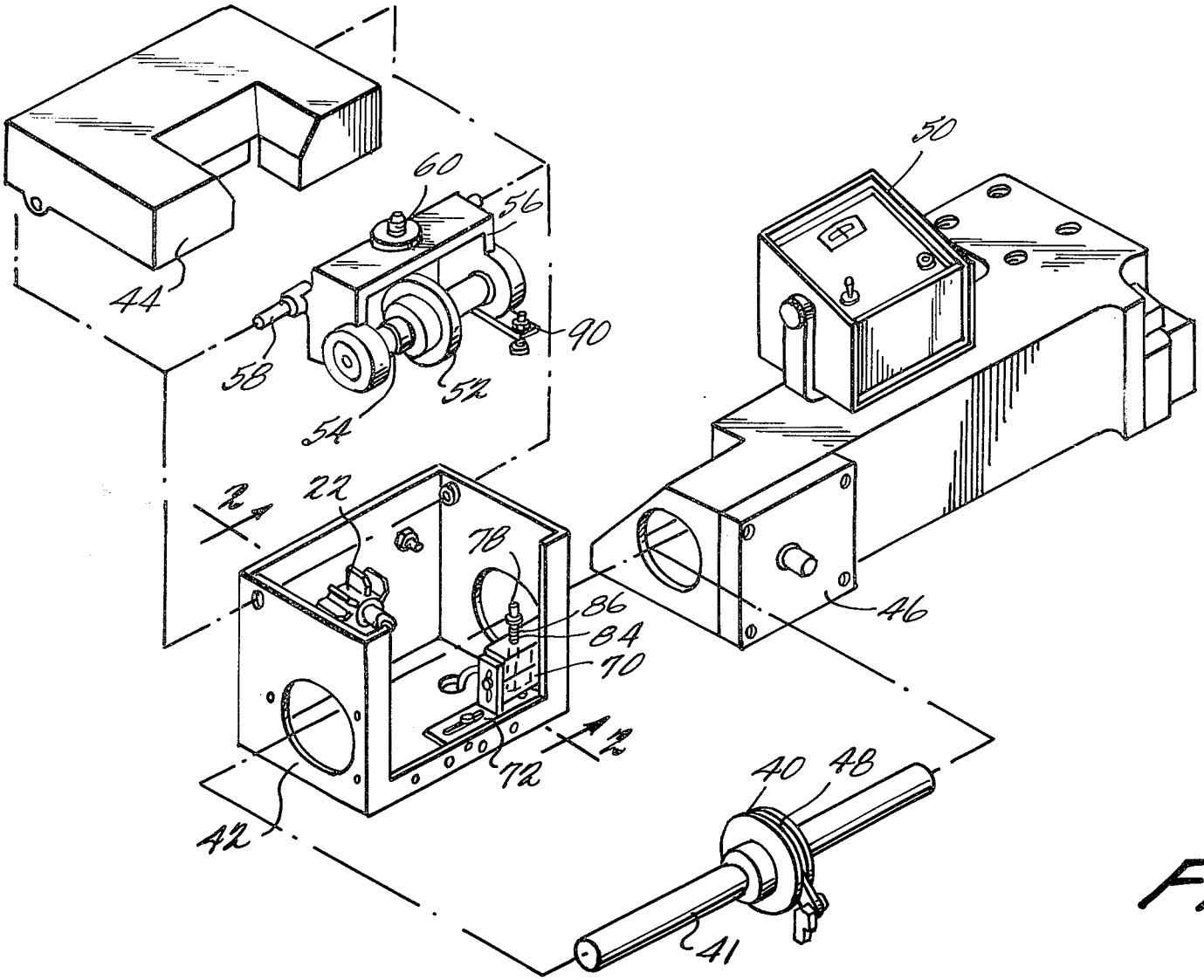
FIG. 2 shows an explodeed view of the sensor which produces the electrical signals for varying the sliver thickness and density.
Figure 3:
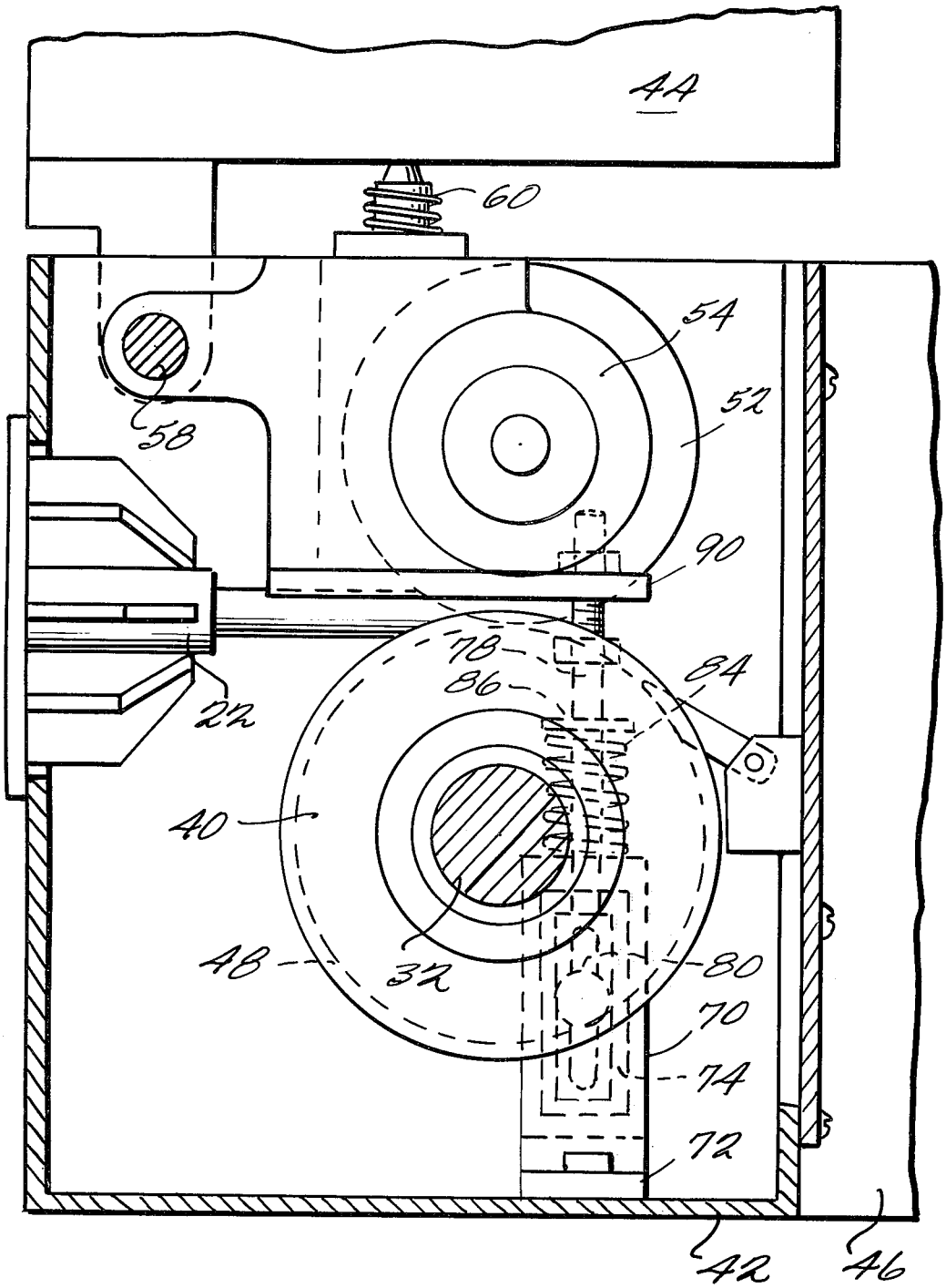
FIG. 3 shows a cut-away view of the assembled structure of FIG. 2 along the lines 3—3.

Reference is now made to FIGS. 2 and 3 which illustrate in detail the components of sensor 26. As mentioned briefly above, these components include a grooved roller 40 which is driven by motor 34 via axle 41. Roller 40 as well as the other components, are mounted within a housing which is formed of housing portions 42, 44 and 46. Housing portion 46 includes conventional control devices 50 which operate the electrical circuitry illustrated in FIG. 4 described in detail below.

A further grooved roller 52 is likewise mounted for undriven rotation in groove 48 of roller 40. Roller 52 is mounted for rotation about shaft 54 in a bearing member 56 which is pivotally connected by shaft 58 to housing portion 42. A spring 60 urges rotation of bearing member 56 and roller 52 about shaft 58 so as to urge roller 52 into engagement with groove 48 of roller 40.

A transducer 70 is rigidly mounted to the floor of housing portion 42 by a bracket 72 and includes therein a plurality of transformer windings 74 as discussed further below in conjunction with the description of the FIG. 4. Shaft 78 extends upwardly from transducer 70 and includes adjacent the coils 74 a magnetic core element 80 which, as it is moved vertically, changes the coupling between the respective transformer coils 74 and the relative amplitudes of the outputs from those coils as discussed below. Spring 84 engages a collar 86 of shaft 78 urging that shaft upward. The top of shaft 78 engages a lever arm 90 which as can be best seen in FIG. 2 is directly connected to the bearing member 56 so that as the grooved roller 52 moves upward and downward with changes in the thickness of a sliver, arm 90 is likewise shifted to vary the vertical position of shafts 78 and core 80 so that coupling between the coil 74 is likewise varied. Since lever arm 90 extends away from the pivot point of bearing member 56 and is further from that point than roller 52, the movement of that roller is mechanically amplified by lever arm 90.

The web 20 is gathered by conventional trumpet 22 which guides the sliver between rolls 40 and 52 which are continuously rotated as described above.

Figure 4:
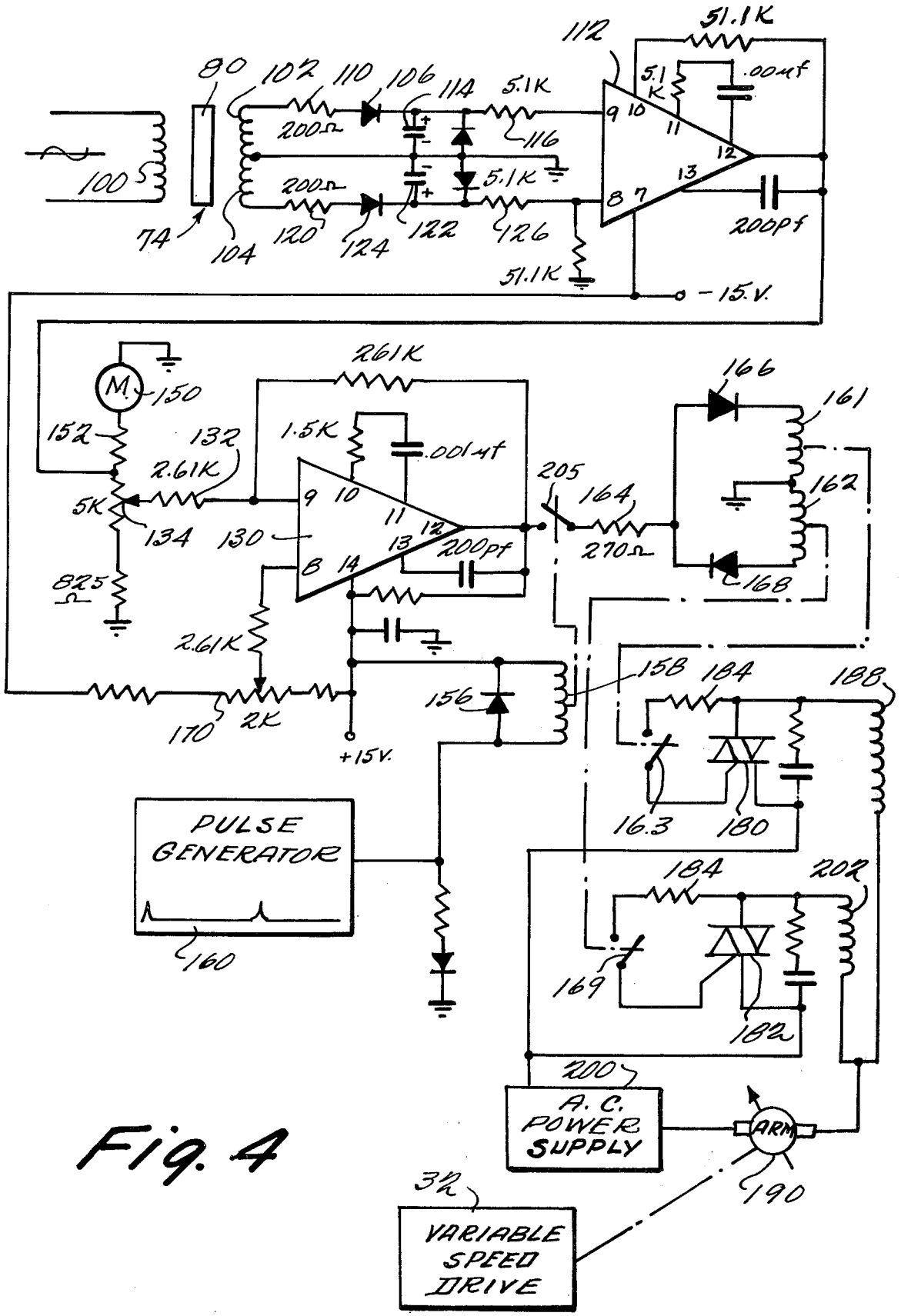
FIG. 4 shows a detailed electrical schematic of the error detection and drive circuitry of this invention.

Reference is now made to FIG. 4 which illustrates in detail the error detection and drive circuitry 36 for maintaining the sliver density or thickness uniform. As the core 80 is moved vertically by shaft 78, the coupling between coils 74, which are comprised of primary coil 100 and a pair of secondary coils 102 and 104, is varied. A suitable alternating current signal is applied to primary coil 100 so that similar voltages are induced in coils 102 and 104 with the amplitude of the induced voltage being a function of the position of core 80. Accordingly, as the core is shifted vertically in response to the variations in the thickness of the sliver, the relative amplitudes of the signals produced at coils 102 and 104 is similarly varied. Since the circuitry responds only to difference, drifting of input voltages has little, if any effect.

The voltage induced at coil 102 is rectified by diode 106 and integrated by the RC circuit comprising resistor 110 and capacitor 114. This voltage is in turn applied as one input to differential amplifier 112 via resistor 116. Similarly, the voltage induced at coil 104 is integrated by the circuit including resistor 120 and capacitor 122 and rectified by diode 124 before being applied to the other input to first differential amplifier 112 via resistor 126. The integration introduces a short time delay which ensures that a minor irregularity will not cause the system to try to adjust an error which does not exist. Conventional differential amplifier 112 produces an output signal which varies as a function of the difference in amplitude between the two input signals which is in turn directly a function of the position of core 80.

The output of differential amplifier 112 is applied as one input to a second differential amplifier 130 via resistor 132 and potentiometer 134. The position of the potentiometer can be adjusted to vary the sensitivity of the system. The voltage applied as the input to amplifier 130 is relatively linear and accordingly the D.C. meter 150 which is connected to potentiometer 134 via resistor 152 provides an indication of the density adjustment which is being made.

Amplifier 130 is connected via a relay contact to an output relay switching system composed of relay coils 161 and 162, contacts 163 and 169 and triac switches 180 and 182.

Contact 205 is activated periodically by a conventional pulse generator 160 which produces a short pulse at periodic intervals, for example, a pulse of 0.3 seconds duration, each 22 seconds to relay coil 158 and shunt diode 156. The pulse separation is related to the speed of operation of the card and the distance between sensor 26 and the feed rolls. It can be easily ascertained for any particular situation.

Each pulse actuates contact 205 and causes the output of amplifier 130 to be applied to relay coil 161 or 162 through diodes 166 or 168 dependent upon the polarity of the amplifier 130 output.

During the interval between pulses produced by generator 160 the amplifier is disconnected by contact 205 from output relays 161 and 162.

Accordingly, the thickness of the sliver is continuously monitored and periodically corrected. The time between corrections or samples allows the previous correction to be tested before an additional correction is made. Without the sampling or correction interval the sliver would tend to oscillate above and below a desired density at a rate determined by the overall time constant of the system. Because the leveling action is of a long term nature, many small corrections will prevent the sliver from overshooting the desired density, while the card and feed system maintain the short term variations.

When the amplifier 130 has a positive output (in excess of 9 volts), relay coil 161 is actuated (etc.).

Similarly, when the output of amplifier 130 has a negative value (in excess of 9 volts) etc.

The output of amplifier 130 is applied to conventional relays 161 and 162 via resistor 164 and diodes 166 and 168. When the amplifier 130 has a positive output, relay coil 161 is actuated as current flows through coil 161 via diode 166. Similarly, when the output of amplifier 130 has a negative value, current flows through negative relay coil 162 via diode 168. Core 80 is preferably positioned and amplifiers 112 and 130 adjusted so that when amplifier 130 produces a positive output, the thickness of the sliver needs to be adjusted from a desired value in one direction whereas when a negative output is produced it needs to be adjusted in the other direction. Change in a desired value is manually done by varying potentiometer 170 which provides the second input to differential amplifier 130.

Relay coils 161 and 162 respectively control switches 163 and 169 which are connected to triacs 180 and 182 respectively via resistors 184. Triac 180 when activated permits current to flow through coil 188 to armature 190 of motor 34 as described briefly above in conjunction with FIG. 1. Motor 190 when actuated mechanically shifts the position of variable speed drive 32 in order to adjust the relative speeds of the doffer roller and feed roll and accordingly the thickness and density of the sliver. An A.C. power source 200 is directly connected to armature 190 for supplying electrical power to that armature. Similarly, when a triac 182 is conductive, current flows through coil 202 causing the armature to rotate in the opposite direction and the thickness of the sliver to be adjusted accordingly.

Many changes and modifications in the above-described embodiment of the invention can, of course, be carried out without departing from the scope thereof and accordingly that scope is intended to be limited only by the appended claims.

What is claimed is:

1. An apparatus for maintaining the density of sliver strands substantially uniform comprising:

sensor means having a pair of sensor members mounted for continuously passing therebetween a sliver so that one of the members moves as a function of sliver density, core means coupled to said one member for movement therewith, transformer means having a primary coil and first and second secondary coils coupled by said core means so that the amplitude of the output voltages by said secondary coils varies as a function of the position of said core means, differential amplifier means connected to said transformer means for producing a signal which varies as a function of the difference in amplitude between the voltages at said secondary coils, pulse generator means for producing a series of activating pulses, further amplifier means connected to said pulse generator means and said differential amplifier means for producing an amplified output only when the pulse generator is producing an activating pulse, and means connected to said further amplifier means for causing the sliver thickness to vary as a function of said amplified output.

2. An apparatus as in claim 1 wherein said sensor means includes a first roller having a groove disposed about its periphery, means for mounting said first roller for rotation, a second roller, means for mounting said second roller for rotation while riding in said groove, and for movement toward and away from said first roller, a lever arm connected to said second roller for movement therewith toward said first roller, shaft means mounting said core means for movement therewith and engaging said lever arm, and means for mounting said coils about said core means.

3. An apparatus as in claim 2 wherein said sensor means includes a housing and said second roller mounting means includes a bearing member, means for pivotally mounting said bearing member about a first axis, means for pivotally mounting said second roller about a second axis displaced from said first axis, and spring means engaged between said bearing member and said housing for urging pivoting of said bearing member toward said first roller and wherein said lever arm extends outward, away from said first axis.

4. An apparatus as in claim 1 further including rectifying means serially connected to each of said secondary coils and integrating means serially connected to each of said secondary coils.

5. An apparatus as in claim 1 further including a DC meter connected to the output of said differential amplifier means.

6. An apparatus as in claim 1 wherein said causing means includes first relay means and serially connected diode means connected to the output of said further amplifying means for activating said first relay means when the output is positive, second relay means and serially connected diode means connected to the output of said further amplifying means for activating said second relay means when the output is negative, first switch means operated by one of said relay means for closing when that relay means is acitvated, a first motor winding coil for rotating a motor in a first direction, first electronic switching means activated when said first switch is closed to complete a current path through said first motor winding coil, a second motor winding coil for rotating a motor in a second direction, second electronic switching means activated when said second switch is closed to complete a current path through said second motor winding coil, a pair of sliver rollers operating at different speeds to produce said sliver, and means for controlling the rotation speed of at least one said sliver rollers connected to said motor to vary the rotation speed as a function of the motor position.

7. An apparatus as in claim 6 wherein said electronic switching means each includes a triac.

8. An apparatus as in claim 1 further including a card.

* * * * *